US006655538B2

(12) United States Patent
Saulnier-Matteini

(10) Patent No.: US 6,655,538 B2
(45) Date of Patent: Dec. 2, 2003

(54) TELESCOPING ADJUSTABLE-LENGTH SHELF

(76) Inventor: Anne Louise Saulnier-Matteini, 18696 Aspesi Dr., Saratoga, CA (US) 95070

( * ) Notice: Subject to any disclaimer, the term of this patent is extended or adjusted under 35 U.S.C. 154(b) by 0 days.

(21) Appl. No.: 10/041,208

(22) Filed: Jan. 8, 2002

(65) Prior Publication Data

US 2003/0132181 A1 Jul. 17, 2003

(51) Int. Cl.[7] ..... A47F 5/08; A47H 1/02

(52) U.S. Cl. ..... 211/153; 211/175; 211/88.02; 211/105.1

(58) Field of Search ..... 211/153, 175, 211/90.02, 88.02, 105.1–105.6, 123, 88.04, 88.01, 205, 124, 133.4, 126.5, 16, 85.12, 119.003, 204; 108/29, 42; 248/326, 333, 258–260, 256, 257, 218.4, 214, 251, 424, 200.1

(56) References Cited

U.S. PATENT DOCUMENTS 1,837,046 A * 12/1931 Hirschberger ..... 160/330
2,979,155 A * 4/1961 Scharfenberger ..... 182/222
3,563,182 A * 2/1971 MacFarlane ..... 211/124
3,954,182 A * 5/1976 McEvers ..... 211/94.01
3,995,330 A * 12/1976 Meyers ..... 4/145
4,036,369 A * 7/1977 Eisenberg ..... 211/88.02
4,118,087 A * 10/1978 Dorf ..... 312/291
4,155,312 A * 5/1979 Thorkildson ..... 108/137
4,195,577 A * 4/1980 Gross ..... 108/31
4,366,774 A * 1/1983 Haake et al. ..... 119/452
4,771,899 A * 9/1988 Benedict et al. ..... 211/60.1
4,819,812 A * 4/1989 Demarest, Jr. ..... 211/1.3
4,854,456 A * 8/1989 Lee ..... 211/14
4,934,015 A * 6/1990 Mink ..... 15/268
5,014,860 A * 5/1991 Emery ..... 211/106
5,145,655 A * 9/1992 Darlak ..... 422/300
5,322,173 A * 6/1994 Kay ..... 211/153
5,588,543 A * 12/1996 Finger ..... 211/90.01
D379,891 S * 6/1997 Hampshire ..... D6/525
5,642,818 A * 7/1997 Brent et al. ..... 211/70.5
5,702,010 A * 12/1997 Liang ..... 211/105.1
D388,642 S * 1/1998 Winter ..... D6/525
5,873,311 A * 2/1999 Schlattl ..... 108/44
5,931,315 A * 8/1999 Lorentz et al. ..... 211/40
6,145,677 A * 11/2000 Corniel ..... 211/105.1
6,233,877 B1 * 5/2001 Monroe ..... 52/37
6,334,541 B1 * 1/2002 Chang ..... 211/88.01
6,435,359 B1 * 8/2002 Priminano ..... 211/75
6,443,318 B1 * 9/2002 Welsch ..... 211/90.02

* cited by examiner

*Primary Examiner*—Daniel P. Stodola
*Assistant Examiner*—Jennifer E. Novosad

(57) ABSTRACT

An adjustable-length shelf system attached to a telescoping rod assembly formed by two hollow tubes, allowing this rod to house a chosen tension mechanism, so that the shelf can then be secured between two supports. The shelf system consists of the main shelf piece attached to the first hollow tube, a telescoping section of shelf not attached but slidably overlaying and fitting within the main shelf piece, and a shelf bracket attached to the end of the second hollow tube. In the closed position, with the telescoping section positioned into the main shelf piece, the rod is extended to fit in a given space between two supports. Once the rod is installed, the telescoping section is extended and secured to the bracket.

17 Claims, 9 Drawing Sheets

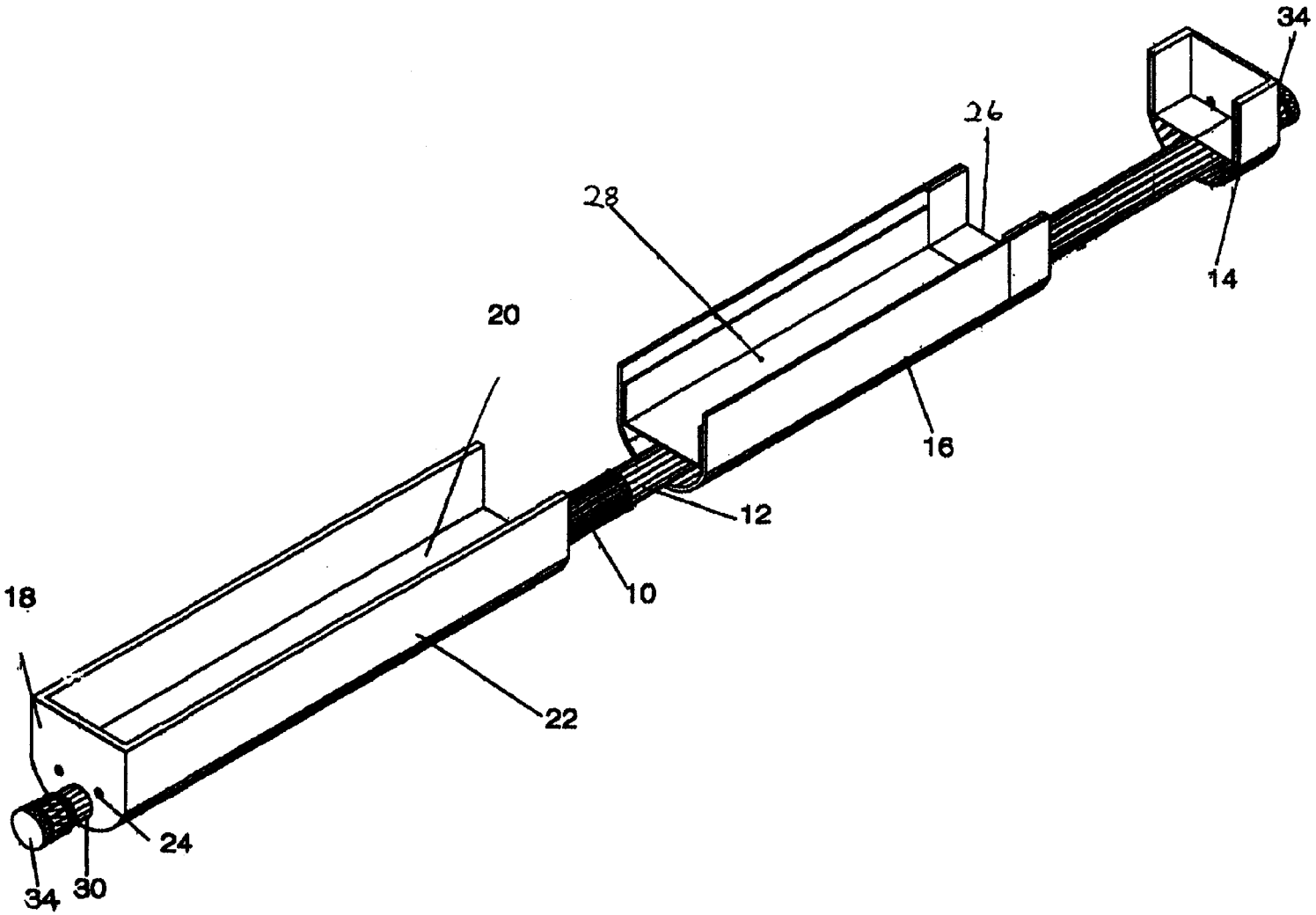
FIGURE NO. 1

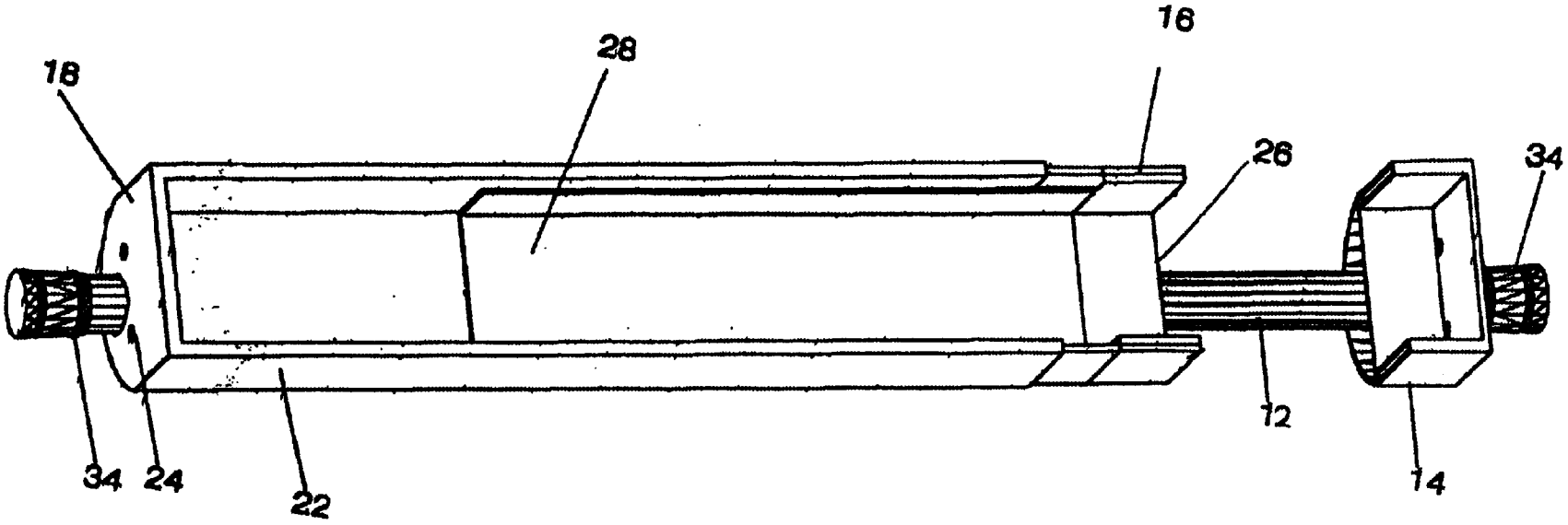
FIGURE NO. 2

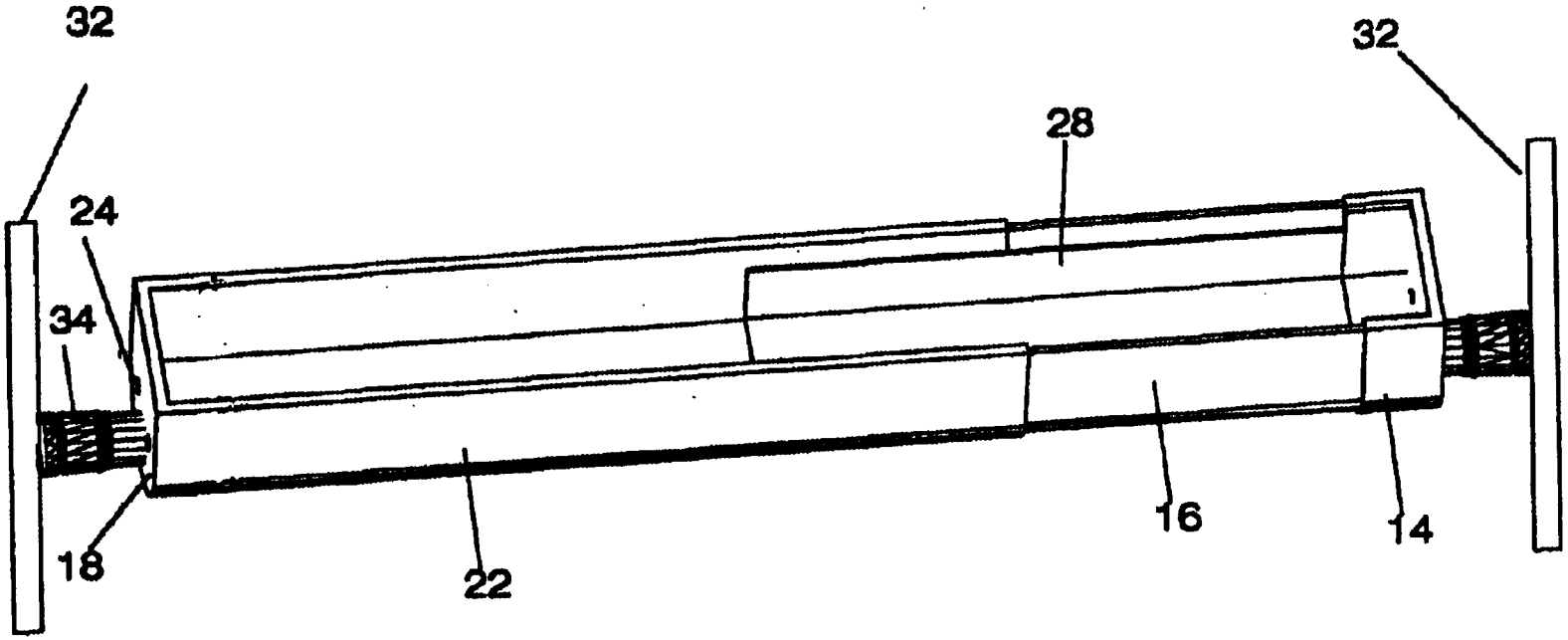
FIGURE NO. 3

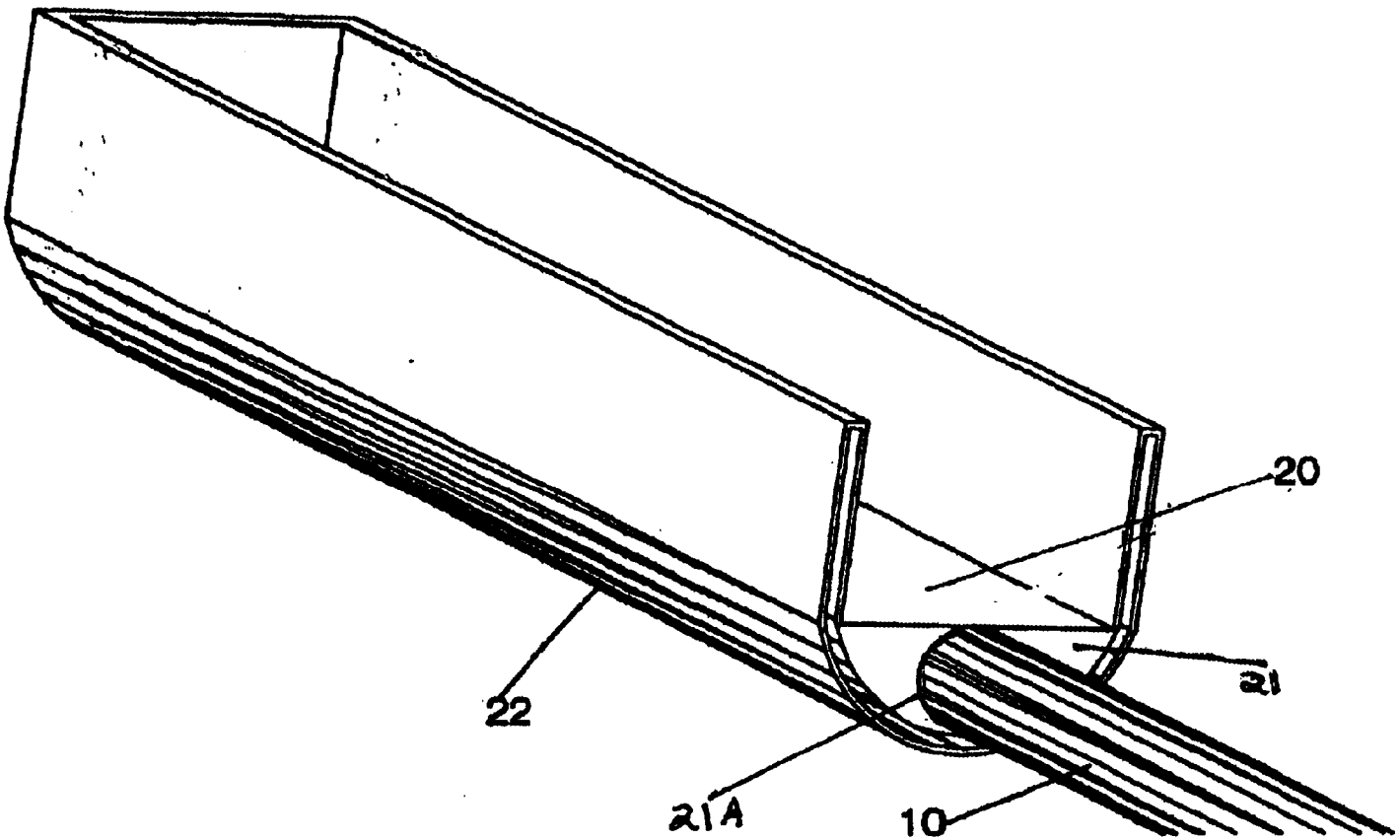
FIGURE NO. 4

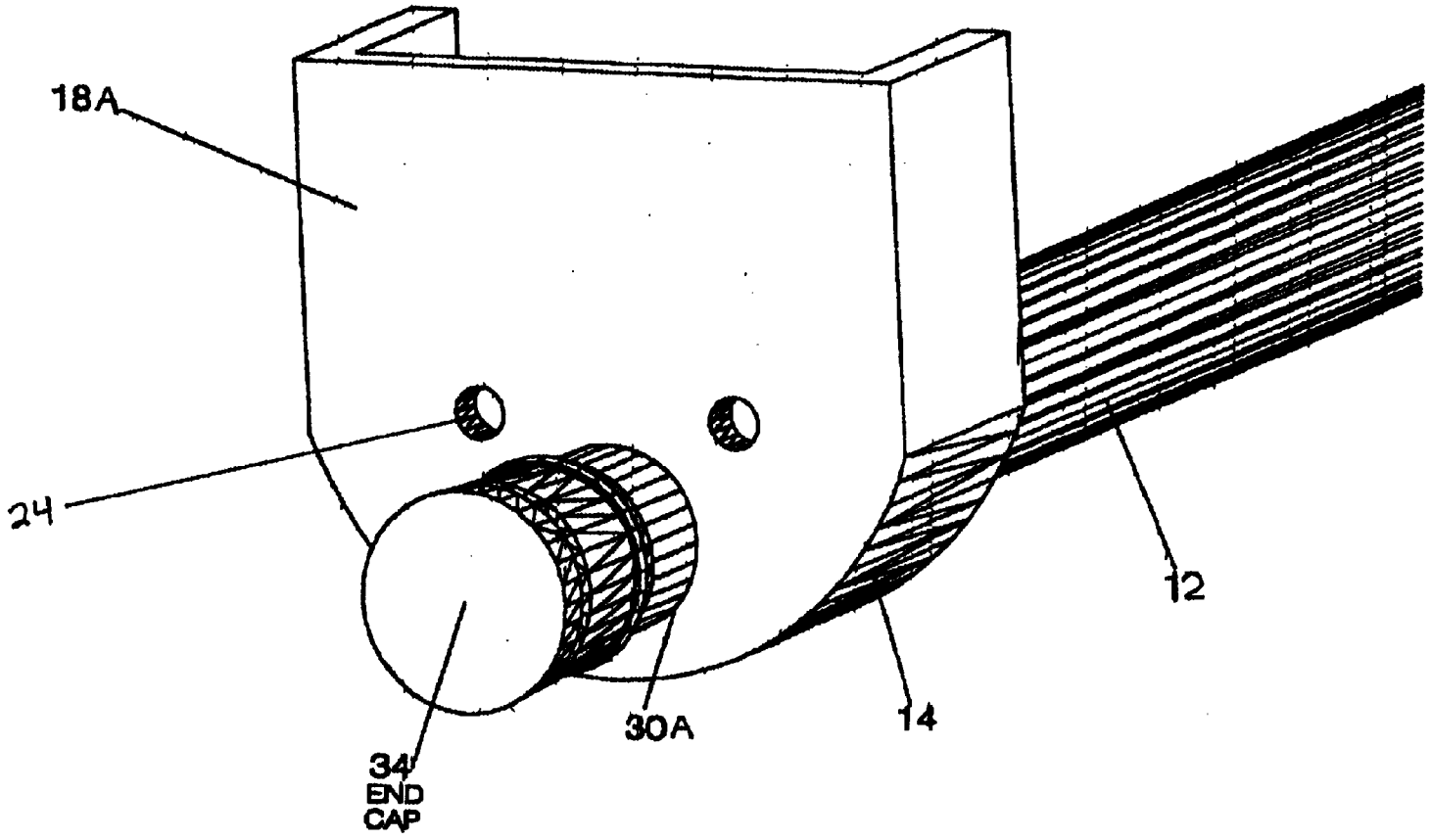
FIGURE NO. 5

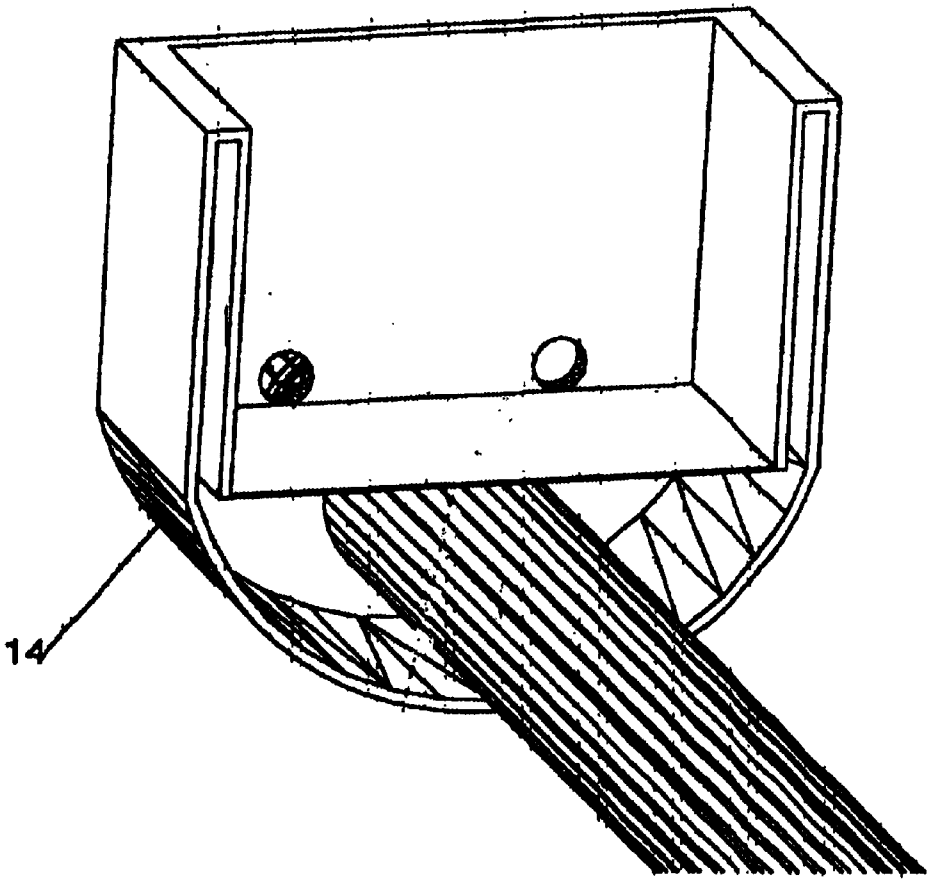
FIGURE NO. 6

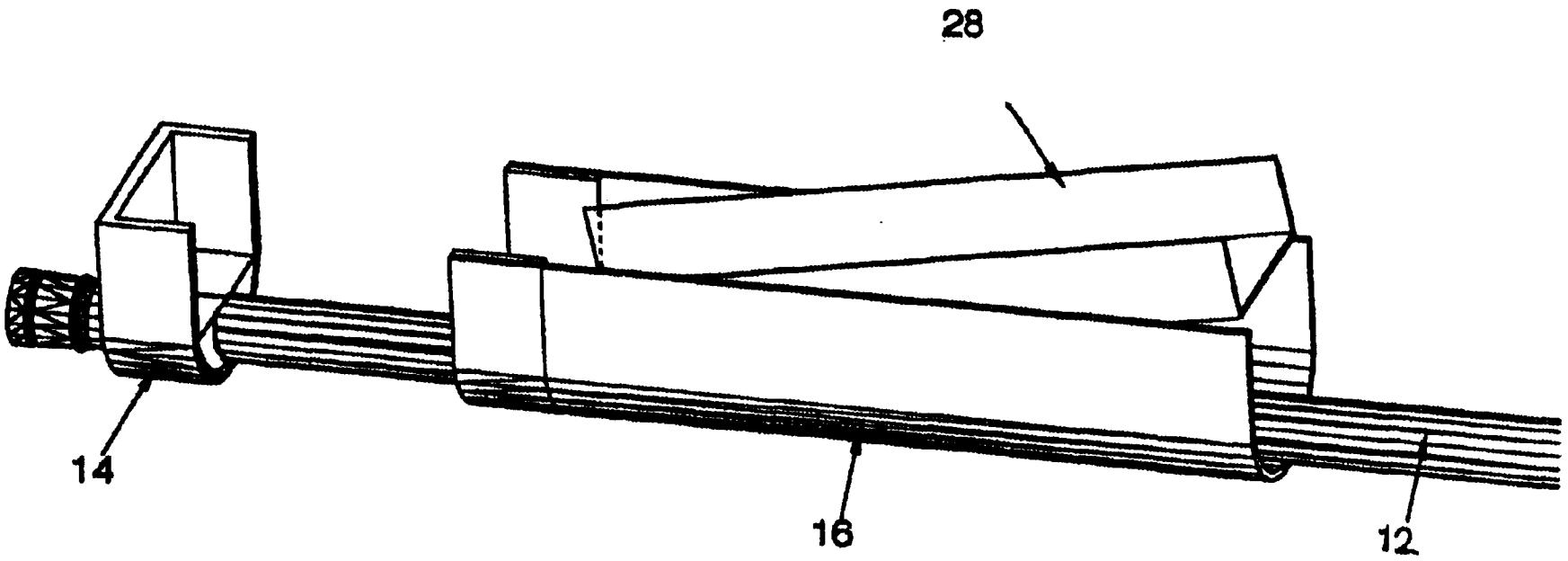
FIGURE NO. 7

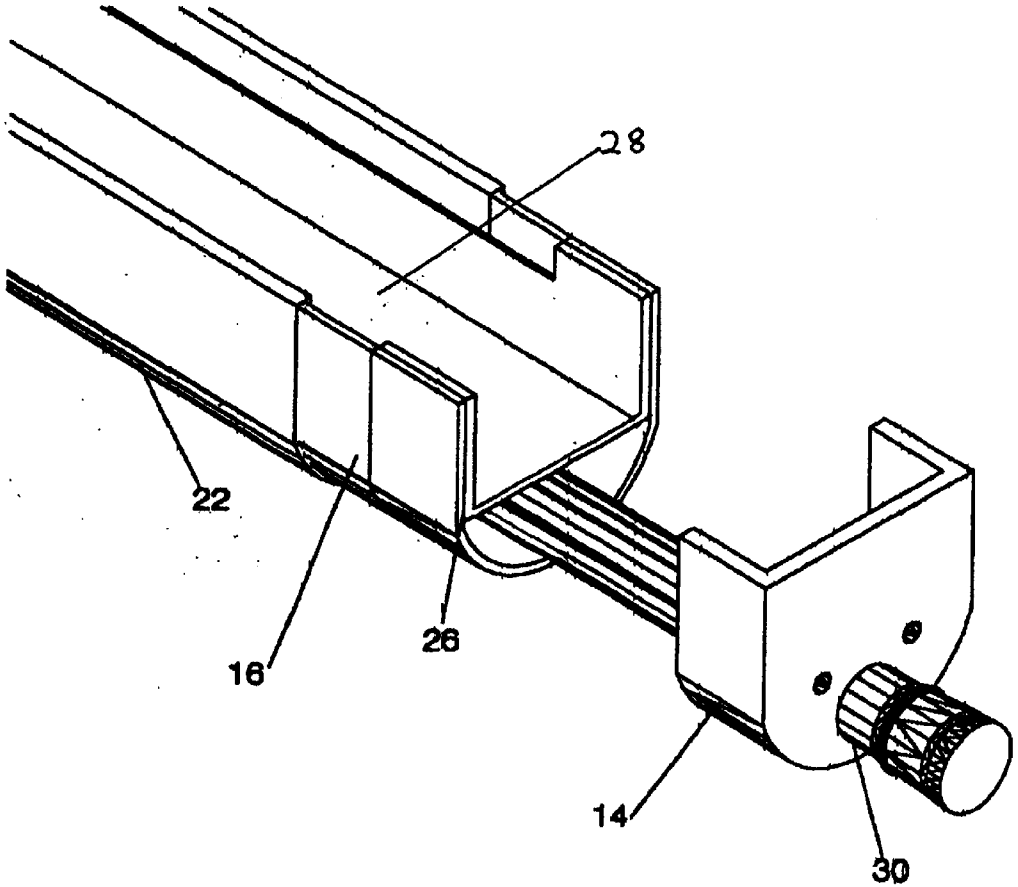
FIGURE NO. 8

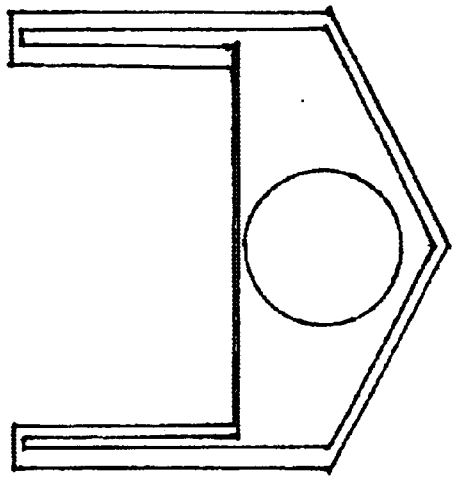
Figure No 9B
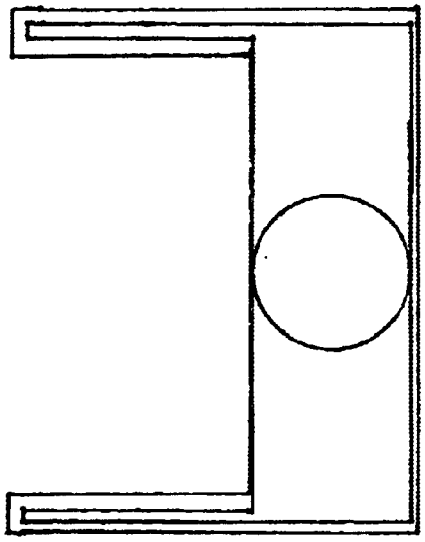
Figure No 9A

TELESCOPING ADJUSTABLE-LENGTH SHELF

BACKGROUND

FIELD OF INVENTION

The present invention relates to bath caddies and more specifically a shelf assembly attached to a telescoping rod, which can be secured between two supports.

BACKGROUND

DESCRIPTION OF PRIOR ART

| | | |
|---|---|---|
| 5,014,860 | May, 1991 | Emery |
| 5,588,543 | Dec., 1996 | Finger |
| D379,891 | June, 1997 | Hampshire |

Caddies and related support devices for use in the bathroom are well known. Many such caddies are readily mountable in the bathtub or adjacent structures. The caddy provides a convenient and efficient location for storing accessories, which are often used in the tub or while taking a shower. Such accessories often include shampoos, soaps, and shaving accessories.

There are different methods of installing shower caddies. Suction cups as shown in U.S. Pat. No. D379,891 to Hampshire and U.S. Pat. No. 5,014,860 to Emery can adhere to a shower wall, but have a tendency to lose suction after a while.

Racks designed to be hung, as shown in U.S. Pat. No. 5,588,543 to Finer are not stable.

Caddies with mounts secured to a wall are very stable, but not easily moved or removed. Securing brackets to a wall will normally damage the wall, and requires repair when removed.

It occurred to me that a need exists for an adjustable length shelf, which can be easily installed or removed without the need for mounting hardware secured to a wall.

OBJECTS AND ADVANTAGES

Accordingly, besides the objects and advantages of bath caddies described above, several objects and advantages of the present invention are:

(a) to provide shelf space which can be used singularly or in plurality.

(b) to provide a shelf which can be adjusted in length to fit between two support pieces.

(c) to provide a shelf which can be installed with or without being permanently attached to a surface.

(d) to provide shelf space anywhere provided there are two supports available.

DRAWING FIGURES

The invention will now be described by way of non-limiting examples, with reference to the attached drawings in which:

FIG. 1 is a top sectional view of an exemplary embodiment of the present invention;

FIG. 2 is a top view of the present invention in the closed position;

FIG. 3 is a view of the present invention in the opened and installed position;

FIG. 4 is a view of the main shelf section;

FIG. 5 is a view of the outside of the shelf bracket;

FIG. 6 is a view inside the shelf bracket;

FIG. 7 is a view of the movement of the inner telescoping shelf piece;

FIG. 8 is a view of the edge where the moveable shelf piece is attached to the outer shell of the telescoping shelf section;

FIGS. 9*a* and 9*b* show cross sectional views of possible shapes of the shelf assembly.

REFERENCE NUMERALS IN DRAWINGS

| | | | |
|---|---|---|---|
| 10 | first hollow tube | 12 | second hollow tube |
| 14 | shelf bracket | 16 | telescoping shelf section |
| 18 | outer wall of main shelf section | 18A | bracket wall |
| 21A | hole on inner wall 21 | 22 | main shelf section |
| 24 | drainage holes | 26 | edge where moveable shelf piece attaches |
| 28 | flexible inner shelf pieces | 30 | hole in outer wall of main shelf section |
| 30A | hole in bracket wall | 32 | support wall |
| 34 | end cap | | |

SUMMARY

An adjustable-length shelf system, fabricated onto a hollow rod in which the inside can be modified to be able to house a chosen tension mechanism, so that the shelf can then be secured between two vertical supports.

DESCRIPTION

FIGS. 1 to 9B

There is shown in FIGS. 1, 2, and 3 a telescoping shelf assembly that can be made of plastic, wood, metal, and cardboard, to support storage of intended items when shelf is installed.

As seen in FIG. 1, the telescoping shelf assembly is comprised of shelf sections in conjunction with a first hollow tube 10 and a second hollow tube 12. Hollow tube 12 is fitted within hollow tube 10 to provide a reasonably tight fit. Hollow tubes 10 and 12 form a rod which has pressure pads 34 secured to the ends.

FIG. 1 shows a main shelf section 22, and a telescoping shelf section 16. Said main shelf section 22 is attached by molding, gluing, or other securing means to hollow rod 10 at a hole 30 on an end wall 18.

Shown in FIG. 4 is where said main shelf section 22 is permanently attached to hollow tube 10 at a hole 21A on an inner wall 21 of main shelf section.

As can be seen in FIGS. 1, 4, and 6, the lower portions of shelf sections 16 and 22, and shelf bracket 14 fit around hollow tubes 10 and 12. The top portionsof the shelf sections and bracket form shelf surfaces 20 and 28 located above the tubes.

Shown in FIG. 5 is a hole 30A in a bracket wall 18A where the hollow tube 12 is attached to shelf bracket 14.

As shown in FIG. 6, there is space inside the bracket 14 to fit telescoping shelf section 16.

Shown in FIG. 7 is telescoping-shelf section 16, which is not permanently attached to any part of the telescoping shelf assembly.

FIG. 8 shows a location of attachment 26 where the moveable shelf piece 28 is attached to the outside wall of section 16 at the end closest to the bracket 14.

FIGS. 9*a* and 9*b* show different possible cross sectional views.

The present invention has been described in terms of exemplary embodiments. It is contemplated, however, that it may be practiced with modifications, some of which are outlined above, within the scope of the appended claims.

Operation

Shown in FIG. 1 is a telescoping shelf assembly intended to house a selected tension mechanism inside a rod formed from a hollow tube 10 and a hollow tube 12. The rod has pressure pads secured to the ends for helping to make a pressure fit against vertical supports.

The manner of using the telescoping-shelf assembly, with a tension mechanism installed inside the hollow rod, is similar to a tension-based shower curtain rod. While the telescoping-shelf section is in the closed position as shown in FIG. 2, the rod is adjusted in size to fit in an intended space between two supports.

As shown in FIG. 3, once the rod is in place between two supports 32, the telescoping-shelf section is pulled out from the main section of shelf and is inserted into the bracket 14 located on hollow tube 12.

Shown in FIG. 4, a main shelf section 22 is permanently attached to hollow tube 10 at a hole 21A on an inner main shelf section wall 21.

Shown in FIG. 5 is the location of the hole 30A on the shelf bracket wall 18A where shelf bracket 14 is attached to hollow tube 12. Also shown in FIG. 5 are drainage holes 24.

FIG. 6 shows the inside view of shelf bracket 14. Shelf bracket 14 is just slightly larger than shelf section 16 to allow for a reasonably tight fit.

FIG. 7 shows a telescoping shelf section 16. Telescoping shelf section 16 is not permanently attached to any other part of the assembly so that it can be moved into position during installation. An inner shelf piece 28, located on the telescoping section 16, lifts to slide over the inner shelf of main shelf section 22, while the bottom section of 16 fits into the bottom of main shelf section 22.

FIG. 8 shows the location of attachment 26 where the moveable inner shelf section 28 is attached to the outer shell of telescoping shelf section 16.

FIG. 8 also shows the telescoping shelf assembly in the closed position, with section 16 fitted into section 22. While in this closed position, the rod is able to turn to be adjusted in length. Once the right length is achieved for a given space between two supports, the shelf can be placed in position, and the telescoping section 16 pulled out from the main section of shelf 22 and fitted into shelf bracket 14.

Conclusion

Accordingly, the reader will see that the adjustable-length shelf is easy to fit and install in a given space, and can be removed just as easily. In addition, it can be placed at a convenient height for accessibility in a shower or bath, or high enough to avoid being in the spray of water. This invention can be used in plurality for added shelf space.

Although the description above contains many-specificities, these should not be construed as limiting the scope of the invention but as merely providing illustrations of some of the presently preferred embodiments of this invention. For example, the method of water drainage could consist of numerous holes along the entire shelf structure. The shelf can vary in color, shape, and dimensions, etc. The number of hollow tubes may vary depending on the application, and the inside of the hollow tubes may be modified depending on the tension mechanism being used. The telescoping shelf section could have the end bracket attached to it, to be secured in place on the rod by other locking means. The telescoping shelf section could be eliminated all together, resulting in one shelf section attached to an adjustable length rod. The adjustable-length shelf could be installed with permanent brackets on the supporting walls eliminating the need for a tension mechanism, etc.

Thus the scope of the invention should be determined by the appended claims and their equivalents, rather than by the examples given.

What is claimed is:

1. An adjustable length shelf system adapted to be mounted between two vertical supports, the system comprising:

(a) a main shelf section (22) having a predetermined length and cross-sectional shape, the main shelf section having a lower portion attached around a bottom side of a first hollow tube (10) and a top portion thereof extending above the tube thereby forming a shelf surface (20), whereby the first hollow tube has a first end adapted to be biased against one of the vertical supports and a second end, and (b) a telescopic shelf section (16) comprising a first piece (26) and an inner shelf piece (28) whereby the telescopic shelf section has a predetermined cross-sectional shape substantially identical to the main shelf section (22) whereby a lower portion of the first piece (26) is slidable around the first hollow tube (10) and a second hollow tube (12), and a top portion of the first piece forms a shelf surface and extends above and slidably overlays the second tube, the inner shelf piece (28) defining a shelf surface slidably overlaying the first and second hollow tubes (10 and 12) and the shelf surface (20) of the main shelf section (22), whereby a first end of the second hollow tube is inserted into the second end of the first hollow tube and a second end of the second hollow tube is adapted to be biased against the other one of the vertical supports;

wherein the system can be assembled to span the distance between the vertical supports by biasing the first end of the first hollow tube and the second end of the second hollow tube against respective vertical supports and slidably moving the first piece (26) of the telescopic shelf section (16) over the second hollow tube (12) towards the main shelf section (22) and lifting and sliding the inner shelf piece (28) over the second tube towards the second end of the second tube so that the top portions of the main shelf section and telescopic shelf section form a substantially horizontal shelf that substantially spans the distance between the vertical supports.

2. The system of claim 1, wherein the first end of the first tube and the second end of the second tube each have a pressure pad attached thereto to be pressed against the vertical supports.

3. The system of claim 1, wherein the main shelf section is permanently attached to the first hollow tube whereby the first tube extends through a hole in the lower portion of the main shelf section.

4. The system of claim 1, wherein the length of the shelf section is substantially equal to the length of the first tube.

5. The system of claim 1, wherein the cross-sectional shape of the main shelf section and telescopic shelf section is substantially rectangular.

6. The system of claim 1, further comprising a bracket section (14) having a predetermined cross-sectional shape substantially identical to the main shelf section (22) and the telescopic shelf section (16) whereby the bracket section is attached adjacent to the second end of the second hollow tube, the bracket section having a lower portion attached around a bottom side of the second tube and a top portion extends above the tube to thereby form a shelf surface.

7. The system of claim 6, wherein the width of the bracket section is larger than the width of the telescopic shelf section.

8. The system of claim 6, wherein the bracket section is attached to the second hollow tube by the second tube extending through a hole in the lower portion of the bracket section.

9. The system of claim 6, wherein the bracket section further comprises at least one drainage hole.

10. An adjustable length shelf system adapted to be mounted between two vertical supports, the system comprising:

(a) a main shelf section (22) having a predetermined length and cross-sectional shape, the main shelf section having a lower portion attached around a bottom side of a first hollow tube (10) and a top portion thereof extending above the tube thereby forming a shelf surface (20), whereby the first hollow tube has a first end adapted to be biased against one of the vertical supports and a second end;

(b) a telescopic shelf section (16) comprising a first piece (26) and an inner shelf piece (28) whereby the telescopic shelf section has a predetermined cross-sectional shape substantially identical to the main shelf section (22) whereby a lower portion of the first piece is slidable around the first hollow tube (10) and a second hollow tube (12), and a top portion of the first piece (26) forms a shelf surface and extends above and slidably overlays the second tube, the inner shelf piece (28) defining a shelf surface slidably overlaying the first and second hollow tubes (10 and 12) and the shelf surface (20) of the main shelf section (22), whereby a first end of the second hollow tube is inserted into the second end of the first hollow tube and a second end of the second hollow tube is adapted to be biased against the other one of the vertical supports; and (c) a bracket section (14) having a predetermined cross-sectional shape substantially identical to the main shelf section (22) and the telescopic shelf section (16) whereby the bracket section is attached adjacent to the second end of the second hollow tube, the bracket section having a lower portion attached around a bottom side of the second tube and a top portion extends above the tube to thereby form a shelf surface;

wherein the system can be assembled to span the distance between the vertical supports by biasing the first end of the first hollow tube and the second end of the second hollow tube against respective vertical supports and slidably moving the first piece (26) of the telescopic shelf section (16) over the second hollow tube towards the main shelf section and lifting and sliding the inner shelf piece (28) over second tube towards the bracket section (14) so that the top portions of the main shelf section, telescopic shelf section and bracket section form a substantially horizontal shelf that substantially spans the distance between the vertical supports.

11. The system of claimed 10, wherein the first end of the first tube and the second end of the second tube each have a pressure pad attached thereto to be pressed against the vertical supports.

12. The system of claim 10, wherein the main shelf section is permanently attached to the first hollow tube whereby the first tube extends through a hole in the lower portion of the main shelf section.

13. The system of claim 10, wherein the length of the shelf section is substantially equal to the length of the first tube.

14. The system of claim 10, wherein the cross-sectional shape of the main shelf section and telescopic shelf section is substantially rectangular.

15. The system of claim 10, wherein the width of the bracket section is larger than the width of the telescopic shelf section.

16. The system of claim 10, wherein the bracket section is attached to the second hollow tube by the second tube extending through a hole in the lower portion of the bracket section.

17. The system of claim 10, wherein the bracket section further comprises at least one drainage hole.

* * * * *